United States Patent [19]

Eckert

[11] 3,975,232

[45] Aug. 17, 1976

[54] THREE STAGE PROCESS FOR PULPING LIGNOCELLULOSIC MATERIALS INCLUDING A CYANIDE ION CONTAINING FIRST STAGE

[75] Inventor: Robert C. Eckert, Charleston, S.C.

[73] Assignee: Westvaco Corporation, New York, N.Y.

[22] Filed: June 19, 1975

[21] Appl. No.: 588,285

Related U.S. Application Data

[63] Continuation-in-part of Ser. No. 416,923, Nov. 19, 1973, abandoned.

[52] U.S. Cl. ..... 162/65; 162/70; 162/82; 162/86; 162/90

[51] Int. Cl.[2] ..... D21C 3/02; D21C 9/10

[58] Field of Search ..... 162/65, 25, 70, 82, 162/86, 90; 8/111

[56] References Cited

UNITED STATES PATENTS

| | | | |
|---|---|---|---|
| 3,384,533 | 5/1968 | Robert et al. | 162/65 |
| 3,532,596 | 10/1970 | Bills et al. | 162/70 |
| 3,652,386 | 3/1972 | Noreus et al. | 162/65 |
| 3,663,358 | 5/1972 | Falkehag et al. | 162/70 |
| 3,691,008 | 9/1972 | Worster et al. | 162/65 X |

*Primary Examiner*—S. Leon Bayshore
*Assistant Examiner*—Arthur L. Corbin
*Attorney, Agent, or Firm*—Richard L. Schmalz; Ernest B. Lipscomb, III

[57] ABSTRACT

A three stage process for pulping lignocellulosic materials, preferably softwood chips comprising: as a first stage treating the lignocellulosic material with a cyanide ion-containing solution at a pH between 7 and 12 to form cyanohydrin groups; in a second stage digesting the thus treated lignocellulosic material with an alkali metal pulping solution containing hydroxyl ions; and as a third stage treating the thus digested lignocellulosic material with 1% to 12% by weight sodium hydroxide, as sodium oxide based on o.d. pulp from the alkaline pulping stage, in the presence of an excess of oxygen.

6 Claims, 1 Drawing Figure

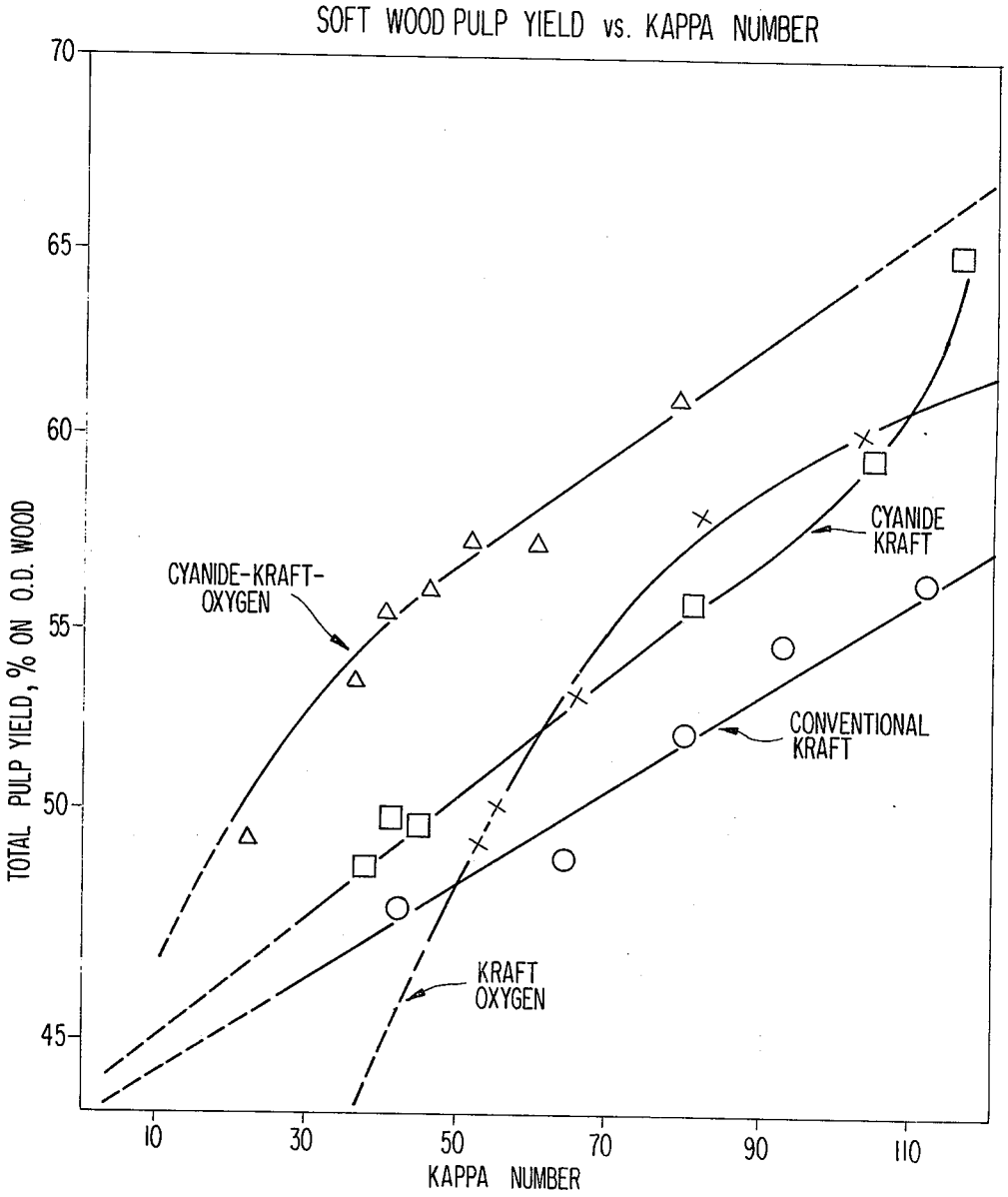
SOFT WOOD PULP YIELD vs. KAPPA NUMBER
TOTAL PULP YIELD, % ON O.D. WOOD
70
65
60
55
50
45
10
30
50
70
90
110
KAPPA NUMBER
CYANIDE-KRAFT-OXYGEN
CYANIDE KRAFT
CONVENTIONAL KRAFT
KRAFT OXYGEN

THREE STAGE PROCESS FOR PULPING LIGNOCELLULOSIC MATERIALS INCLUDING A CYANIDE ION CONTAINING FIRST STAGE

CROSS-REFERENCE TO RELATED APPLICATION

This application is a continuation-in-part of copending application, Ser. No. 416,923, filed Nov. 19, 1973, now abandoned.

BACKGROUND OF THE INVENTION

1. Field of the Invention

This invention relates to the manufacture of pulp from lignocellulosic material, and in particular wood pulp from softwood. More particularly, this invention relates to a three-stage process for the treatment of lignocellulosic material, in particular softwood chips to produce pulp comprising, first treating the lignocellulosic material with a cyanide ion-containing solution, second pulping in an alkaline pulping stage, and third treating with oxygen.

2. Description of the Prior Art

As is well known, any improvement in yield obtained from the pulping of wood chips without serious loss of physical properties of the resulting pulp is important to the paper industry. In fact, the increase in yield of the pulping process by as much as 1% or 2% is significant and is highly desirable if the economic costs are justified. Consequently, numerous attempts have been made to improve pulp yields. These attempts include various chemical processes for treating lignocellulosic material, as well as, varying digesting parameters of these processes.

Lignocellulosic materials (such as wood from coniferous and deciduous species of trees) contain lignin, cellulose, and hemicelluloses. The lignin and hemicelluloses, such as gluco-mannan chains in softwood or glucurono-xylan chains in hardwood, are located both in the cell wall of the fiber and in the inter-fiber spaces, generally termed the middle lamellae. It is highly desirable to retain the hemicelluloses on the surface of the fiber, in which case they can influence the bonding properties of the fibers; and they are also retained in the cell wall of the fiber, improving flexibility and thereby the papermaking properties of the pulp. In order to retain the hemicelluloses, various chemical processes aiding the retention of the hemicelluloses have been proposed. For example, one particularly effective process which encompasses the treatment of the lignocellulosic material prior to digesting with an alkaline pulping solution has been set forth in U.S. Pat. No. 3,532,596 to Bills et al. In the Bills et al. patent, incorporated herein by reference, there is disclosed the reaction of a cyanide ion-containing solution with lignocellulosic materials wherein the cyanide ion in the presence of hydroxyl ions reacts to prevent the peeling of the carbohydrate chain. Although the process set forth in the Bills et al. patent is certainly significant, it is desirable to obtain even higher pulp yields than can be affored by the process of the Bills et al. patent.

It is also to be noted that treatment of pulp through contact with sodium hydroxide in the presence of an excess of oxygen or, in other words, a post pulping treatment with oxygen and the like, has been set forth in U.S. Pat. No. 3,384,583 to Robert et al. and U.S. Pat. No. 3,691,008 to Worster et al. The Robert et al. and Worster et al. patents disclose alkaline pulping processes, which after a conventional alkaline pulping stage the pulps are subjected to oxygenation in a second or post-treatment step to obtain slightly higher unbleached pulp yields, higher unbleached pulp brightness and easier beating and bleachability.

It is, therefore, the general object of this invention to provide a three stage process for pulping lignocellulosic material, in particular softwood chips. Another object of this invention is to provide a three stage process including, a cyanide treatment stage, followed by an alkali metal digestion stage, that followed by an oxygenation stage to provide quality pulps in higher yields.

Other objects, features and advantages of this invention will be evident from reading the foregoing detailed description of the preferred embodiments and the accompanying drawing.

BRIEF DESCRIPTION OF THE DRAWING

The FIGURE is a graph showing how the Total Pulp Yield varies at differing Kappa Numbers using various pulping techniques.

SUMMARY OF THE INVENTION

A three stage process for pulping lignocellulosic materials, preferably softwood chips comprising;

1. treating lignocellulosic material with a cyanide ion-containing solution at a pH between 7 and 12 to form cyanohydrin groups, the cyanide ion-containing solution may also, if desired, contain hydroxyl ions to hydrolyze the cyanohydrin groups into carboxyl groups, withdrawing any excess cyanide ion-containing solution,
2. digesting the thus treated lignocellulosic material with an alkali metal pulping solution containing hydroxyl ions, defibrizing if necessary, and
3. treating the thus digested lignocellulosic material with 1% to 12% by weight sodium hydroxide, as sodium oxide based on o.d. pulp from the alkaline pulping stage, in the presence of an excess of oxygen.

DETAILED DESCRIPTION OF THE INVENTION AND PREFERRED EMBODIMENTS

The first step is to react or treat lignocellulosic material, in particular softwood chips, with a cyanide ion-containing solution to prevent degradation of the carbohydrate chain. Only the treatment of softwood chips are herein described, but it is known that hardwood chips can be beneficially treated by the methods of this invention if adequate diffusion techniques or adjustment of parameters are employed. The first stage comprises treatment under conditions to provide for the diffusion of a cyanide ion-containing solution at a pH between 7 and 12 into the lignocellulosic material. The cyanide ion-containing solution may also contain hydroxyl ions to convert the cyanohydrin group of the carbohydrate chain to a carboxyl group. During the treatment time, reaction of cyanide ions with aldehydic end groups of the carbohydrate chain forms cyanohydrin groups. Hydrolysis of the cyanohydrin groups thus takes place either from hydroxyl ions in the treatment solution or hydroxyl ions from the digesting chemicals, to form carboxyl end groups whereby the lignocellulosic material is protected against alkaline attack. Although the cyanide ion-containing solution is at a pH between 7 and 12, the preferred range is for the pH to be between 8.5 and 10.5.

The cyanohydrin forms more rapidly at higher temperatures, but hydrolysis of cyanide ions directly into ammonia and formic acid is also accelerated at higher temperatures. Thus, to avoid competition between these reactions for available cyanide ions, the diffusion should occur at a temperature below digestion temperature, and preferably at a relatively low temperature such as below 75°C. Although the reaction to form the cyanohydrin can take place at considerably higher temperatures than 75°C., as a practical digestion procedure for wood chips, diffusion and cyanohydrin formation should generally proceed simultaneously. If wood chips are presteamed to drive off the air and thoroughly wet the wood structure, about 70% of the possible reaction occurs in 3 hours at a temperature of 95°C. At a temperature of 130°C., approximately 5 minutes is sufficient; but control and uniformity of cooking conditions are not as reliable. Therefore, an economic penalty must be paid for cyanide ions which become unavailable for cyanohydrin formation because of hydrolysis directly into ammonia and formic acid. Thus, the treatment should occur at temperatures from room temperature to 130°C., and preferably from 75°C. to 95°C.

In the practice of this invention, any aqueous solution containing a cyanide ion may be used. When KCN, for example, is added to water, it readily dissociates into K+ ion and $CN^-$ ion. The cyanide ion then reacts with water:

$$CN^- + H_2O \rightleftarrows HCN\ OH^-$$

Whether derived from HCN gas, liquid hydrogen cyanide, an inorganic compound or an organic compound, any treatment solution therefore contains reactive $CN^-$ ion so that it is immaterial how the cyanide ion is added to the treatment solution. The unbuffered dissociation constant of HCN in water is $7.2 \times 10^{-10}$. Because HCN is known to be effective in cyanohydrin reactions with polysaccharide materials, it is clear that the dissociation constant of a cyanide-supplying compound is not controlling. Consequently, any water-soluble, cyanide-releasing compound may be used to form pretreatment solutions containing cyanide ion in practicing this invention.

Following the prescribed treatment time, which, of course, is dependent upon the particular temperature used, any excess cyanide ion-containing solution is withdrawn from contact with the lignocellulosic material. Any excess liquor can be reused in the first treatment stage. Alternatively, it is possible, as will be evident to those skilled in the art of pulping, to design the first treatment stage such that there is no excess liquor to withdraw at the end of the stabilization reaction. For example, the cyanide ion-containing solution may be applied to the chips and any excess withdrawn immediately. The cyanide containing chips would then be held at the desired treating conditions to provide the proper time and temperature for sufficient stabilization. After obtaining the desired stabilization, alkaline pulping liquor could be directly added to the stabilized chips.

The second stage is referred to as the digestion stage. The digestion of lignocellulosic material under alkaline conditions obviously presents a very large scale field for utilizing the present invention. kraft, soda and neutral or alkaline sulfite digestion processes are currently used for converting large quantities of lignocellulosic material, particularly wood-derived materials, into paper and paper board products. The digesting parameters used will depend upon the particular alkaline digesting process chosen and will be those cooking parameters conventionally used and well known to those skilled in the pulping arts.

In conventional soda pulping, the lignocellulosic material is digested with an aqueous solution of sodium hydroxide at 165°C. to 180°C. according to a cooking schedule which varies with the type of pulp desired. Similarly, conventional kraft pulping utilizes an aqueous solution of sodium hydroxide containing sodium sulfide. The presence of sodium sulfide considerably increases the rate of delignification of the lignocellulosic material and hence results in shorter cooking schedules for kraft pulps compared to soda pulps. Therefore, kraft pulps are generally stronger than soda pulps, probably because briefer cooking procedures produce a less degraded product. The ability to use the subject invention with the soda process is particularly beneficial because there is no sulfur used in the soda process and pollution problems are thus eliminated.

Other alkaline pulping processes useful in the second stage include the alkaline sulfite and neutral sulfite processes. The so-called "neutral" sulfite process actually utilizes a liquor which is alkaline (pH 9–10) at the beginning of the digestion process. This sulfite liquor consists mainly of an aqueous solution of sodium sulfite. During the cook, the pH can drop to about 7 because of the chemical consumption and production of acidic materials from the wood. The pulping action is very mild and hence a considerable amount of time is necessary to pulp to reasonably low lignin content.

Depending upon the process used and the type of pulp desired, the rage of Kappa Number to which one cooks in the digestion stage is from 60 to 160. If the yield and Kappa Number of the pulp following the digestion stage are high, i.e., 55% – 80% yield or Kappa Number above 100, then defiberizing prior to the third stage may be required. Additionally, for some types of pulp it is desirable to wash the pulp after defiberizing.

Following digestion or defiberizing, the lignocellulosic pulp proceeds to the third stage which is referred to as an oxygenation or post digestion stage. In the third stage, sodium hydroxide at 1% to 12% weight of sodium hydroxide, preferably 3% to 8%, calculated as sodium oxide based on o.d. pulp from the alkaline stage, and oxygen are applied to the digested pulp at a temperature from 95°C. to 130°C. Oxygen at a partial pressure of 100 – 200 p.s.i.g. is found to be preferable. It has also been found desirable that the addition of a small quantity of an alkaline earth hydroxide, for example 0.1% to 1.0% magnesium carbonate, be used as a carbohydrate stabilizer to preserve strength properties.

The amount of oxygen consumed or used during the third stage depends upon the Kappa Number of the pulp following digestion. For example, more oxygen (and also more alkali demand) is needed to lower the Kappa Number, to 15 to 40, than is needed to produce, for example, pulps in higher Kappa Number ranges.

Following completion of each of the three of these steps, respectively, the spent treatment material may be recovered and regenerated for reuse by well established methods.

It has been unexpectedly found that a higher yield of pulp may be obtained through the use of the process herein described when using the process of this invention to obtain pulps in the Kappa Number range from 15 to 70. The practice of this invention may clearly be seen in the following examples wherein Exaples 1 – 3 represent the steps of the prior art and Example 4 is illustrative of the invention.

Following the general procedure outlined in Examples 1 – 4, samples of pine chips were pulped to various Kappa Numbers and compared to the effect on yield. These results are shown in the FIGURE.

EXAMPLE 1

Southern pine (softwood) chips were pulped in a pressure cooker by a conventional kraft process (second stage only) under the following conditions to obtain a pulp having a Kappa Number of about 42:

Conditions of the Kraft Cook:

14.7% effective alkali (E.A.) charged as $Na_2O$ on o.d. wood,
23.2% sulfidity of pulping liquor, and
heating to 175°C. in 60 minutes and maintaining the temperature for 50 minutes.

The results are shown in the following table wherein the results are compared to the invention results.

EXAMPLE 2

Southern pine (softwood) chips were treated with a cyanide ion-containing solution and pulped in a pressure cooker by a conventional kraft process at the conditions shown, and similar to those in U.S. Pat. No. 3,352,596 to Bills et al. to obtain a pulp having a Kappa Number of about 44:

Conditions of First Stage or Cyanide Treatment:

| | |
|---|---|
| Treatment Time | 3 hours |
| Treatment Temperature | 50°C. |
| Liquor : Wood Ratio | 5 : 1 |
| Applied NaCN, as HCN on o.d. Wood | 5.40 |

Following the cellulosic stabilization with cyanide, the excess cyanide ion-containing solution was withdrawn and the stabilized chips were subjected to a kraft cook under the following conditions:

Conditions of the Second Stage or Kraft Cook:

14.7% E.A. charged as $Na_2O$ on o.d. wood,
23.2% sufidity of pulping liquor, and
heating to 175°C. in 55 minutes and maintaining the temperature at 175°C. for 20 minutes.

The results are shown in the following table.

EXAMPLE 3

This example shows the results of pulps produced using the second stage (kraft pulping) and third stage (oxygenation) on southern pine chips, similar to those conditions in the third stages described in the Worster et al. patent to obtain a pulp having a Kappa Number of about 53:

Conditions of Second Stage or Kraft Cook:

9.0% E.A. charged as $Na_2O$ on o.d. wood, 23.2% sulfidity of pulping liquor, and heating to 175°C. in 90 minutes.

The results of pulps at this stage in the process as shown in the table. Following digestion, the pulp was treated in the oxygenation stage.

Conditions of the Third Stage or Oxygenation Treatment:

10.5% alkali charged as $Na_2O$ on o.d. wood,
heating to 120°C. in 50 minutes and maintained at 120°C. for 25 minutes,
1% $MgCO_3$ added to pulp, and adding 150 p.s.i.g. $O_2$ at 20% consistency.

The result of pulp treated according to the second and third stages is shown in the table.

Example 4

This example illustrates the process of this invention using the three-stage process. Southern pine (softwood) was first treated with a cyanide ion-containing solution, followed by a kraft cook, followed by the third stage oxygenation treatment. The process conditions were as followed to obtain a pulp having a Kappa Number of about 40:

Conditions of First Stage Treatment:

| | |
|---|---|
| Treatment Time | 3 hours |
| Treatment Temperature | 50°C. |
| Liquor : Wood Ratio | 4.4 : 1 |
| Applied NaCN, as HCN on o.d. Wood | 4.61 |

Conditions of Second Stage or Kraft Cook:

10.8% E.A. as $Na_2O$ on o.d. wood, 23.2% sulfidity of pulping liquor, and heating to 175°C. in 90 minutes.

Results at the End of Second Stage:

| | |
|---|---|
| Unscreened Yield (% of o.d. wood) | 67.3 |
| Kappa Number | 125 |
| E.A. % consumed as $Na_2O$ | 5.3 |

Conditions of Third Stage or Oxygenation Treatment:

6.0% alkali as $Na_2O$ on o.d. wood, heating to 120°C. in 55 minutes and maintained at 120°C. for 25 minutes, 1% $MgCO_3$ added to pulp, and adding 150 p.s.i.g. $O_2$ at 20% consistency.

Results of the Pulp Treated According to the Third Stage of this Invention:

| | |
|---|---|
| Yield on o.d. Pulp, % | 82.1 |
| Yield on o.d. Wood, % | 55.3 |
| Alkali % consumed as $Na_2O$ | 6.0 |
| Kappa Number | 40.2 |

The results obtained from the foregoing examples are shown in the following table and clearly show the significant advantages obtainable using the three-stage process.

COMPARISON OF RESULTS OF PRIOR ART VS. THREE STAGE PROCESS-continued

| | | Example 1 Kraft Alone | Example 2 Cyanide/ Kraft | Example 3 Kraft/ Oxygenation | Example 4 Invention |
|---|---|---|---|---|---|
| 2nd | Kappa Number | 42.3 | 44.3 | 161.0 | 125.0 |
| | Yield [1] (% of o.d. wood) | 47.6 | 49.3 | 66.2 | 67.3 |
| Stage | E.A.[2] consumed as $Na_2O$, % | 11.5 | 8.9 | 7.4 | 5.3 |
| 3rd | Kappa Number | | | 53.0 | 40.2 |
| | Yield[1] (% of o.d. pulp) | | | 73.9 | 82.1 |

| | | Example 1 Kraft Alone | Example 2 Cyanide/ Kraft | Example 3 Kraft/ Oxygenation | Example 4 Invention |
|---|---|---|---|---|---|
| Stage | Yield[1] (% of o.d. wood) | | | 48.9 | 55.3 |
| | Alkali consumed as $Na_2O$, % | | | 10.5 | 6.0 |

Notes: [1]Yield is total yield or unscreened yield.
[2]E.A. is effective alkali.

As noted, the results of pulps at various Kappa Numbers have been compared in the Figure. For example, using the three-stage process of this invention, a pulp at Kappa Number 50 shown in the Figure would have a pulp yield of about 56.3%; whereas, a conventional kraft cook at Kappa Number 50 would yield about 48%; the oxygen treatment to a kraft cook would be detrimental at a Kappa Number of 50 and a cyanide-kraft cook would yield about 50.5%. Thus, the results in the Figure show the clear and unexpected improvement in pulp yields obtained in the 15 to 70 Kappa Number range.

While the invention has been described and illustrated herein by references to various specific materials, procedures and examples, it is understood that the invention is not restricted to the particular materials, combinations of materials and procedures selected for the purpose. Numerous variations of such detail can be employed, as will be appreciated by those skilled in the art.

What is claimed is:

1. A process for pulping lignocellulosic material comprising;

a. treating lignocellulosic material with an aqueous cyanide ion-containing solution at a temperature between room temperature and 130°C. at a pH between 7 and 12 until cyanohydrin groups are formed, withdrawing any excess cyanide ion-containing solution.

b. digesting the thus treated lignocellulosic material with an alkali metal pulping solution containing hydroxy ions at a conventional pulping temperature until a Kappa Number from 60 to 160 is obtained, and c. treating the thus digested lignocellulosic material with 1% to 12% by weight sodium hydroxide, as sodium oxide based on the o.d. pulp from the alkaline stage, and an excess of oxygen at a partial pressure of 100 – 200 p.s.i.g. and temperature between 95°C. and 130°C. until a Kappa Number between 15 and 70 is obtained.

2. The process of claim 1 wherein said lignocellulosic material is in the form of softwood chips.

3. The process of claim 1 wherein said alkali metal pulping solution contains sodium sulfide.

4. The process of claim 1 wherein said alkali metal pulping solution contains sodium sulfite.

5. The process of claim 1 wherein said cyanide treatment is conducted at a temperature below 95°C., and the pH of said cyanide ion-containing solution is between 8.5 and 10.5.

6. The process of claim 1 wherein the lignocellulosic material of step (c) is treated until a Kappa Number between 20 and 40 is obtained.

* * * * *

UNITED STATES PATENT OFFICE

CERTIFICATE OF CORRECTION

PATENT NO. : 3,975,232

DATED : August 17, 1976

INVENTOR(S) : Robert C. Eckert

It is certified that error appears in the above-identified patent and that said Letters Patent are hereby corrected as shown below Column 1, line 60, "affored" should read --afforded--.

Column 1, line 65, "3,384,583" should read --3,384,533--.

Column 3, line 25, "K+" should read --$K^+$--.

Column 3, line 63, "kraft" should read --Kraft--.

Column 4, line 31, "rage" should read --range--.

Column 4, line 50, after "ple" insert --,--.

Column 4, line 67, "Exaples" should read --Examples--.

Column 5, line 26, "3,352,596" should read --3,532,596--.

Column 6, line 1, "as" should read --are--.

Column 7, line 26, "the" should read --that--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*